US005484299A

United States Patent [19]

Schlessinger

[11] Patent Number: 5,484,299

[45] Date of Patent: Jan. 16, 1996

[54] SWITCHING TYPE ELECTRICAL RECEPTACLES HAVING SELECTIVELY ORIENTABLE PLUG-RECEIVING CONTACT CARRIERS

[76] Inventor: Marc A. Schlessinger, 24325 Hilltop Dr., Beachwood, Ohio 44122

[21] Appl. No.: 254,549

[22] Filed: Jun. 6, 1994

[51] Int. Cl.[6] ..... H01R 29/00

[52] U.S. Cl. ..... 439/188; 200/51.1

[58] Field of Search ..... 439/188; 200/51.1

[56] References Cited

U.S. PATENT DOCUMENTS

| | | | |
|---|---|---|---|
| 1,174,379 | 3/1916 | Bacon | 173/324 |
| 1,176,554 | 3/1916 | Herzig | 173/324 |
| 1,247,660 | 11/1917 | Garrison | 173/324 |
| 2,055,999 | 9/1936 | Caldwell | 173/324 |
| 2,414,957 | 1/1947 | Larrabure | 173/324 |
| 2,459,032 | 1/1949 | Korth | 173/324 |
| 2,570,784 | 10/1951 | Ferguson | 173/324 |
| 2,611,068 | 9/1952 | Wellens | 219/19 |
| 5,035,635 | 7/1991 | Tsai et al. | 439/188 OR |
| 5,286,213 | 2/1994 | Altergott et al. | 439/188 X |
| 5,350,310 | 9/1994 | Chen | 439/188 OR |
| 5,429,518 | 7/1995 | Chen | 439/188 OR |

*Primary Examiner*—Larry I. Schwartz
*Assistant Examiner*—Daniel Wittels
*Attorney, Agent, or Firm*—David A. Burge

[57] ABSTRACT

An electrical receptacle includes a nonconductive contact carrier that mounts a set of female electrical contacts that are configured to receive and conductively engage plural conductive prongs of a male plug. The carrier has a generally cylindrical outer wall that is received within a generally cylindrical chamber that is defined by a nonconductive housing. The housing mounts the carrier for rotation about a center axis that extends centrally through the chamber. When the carrier is rotated about the center axis relative to the housing to an "on" position (that resides within a relatively wide angular range of "on" positions), housing-carried electrical contacts that extend through housing-defined passages engage carrier-carried electrical contacts that extend through carrier-defined passages. When the carrier is rotated about the center axis relative to the housing to an "off" position, electrical connection is interrupted between selected pairs of the housing-carried and carrier-carried contacts. A detent preferably is interposed between the carrier and the housing for releasably retaining the rotatable carrier in its "off" position. The rotatability of the carrier while remaining within its range of "on" positions permits a male electrical plug (and an appliance cord or other form of electrical wire that is attached to the plug) to be oriented as desired relative to the receptacle for such purposes as minimizing wear and tear, and/or to accommodate the positioning of furniture at locations near where the receptacle is installed.

20 Claims, 3 Drawing Sheets

SWITCHING TYPE ELECTRICAL RECEPTACLES HAVING SELECTIVELY ORIENTABLE PLUG-RECEIVING CONTACT CARRIERS

BACKGROUND OF THE INVENTION

1. Field of the Invention

The present invention relates to an electrical receptacle having a generally cylindrical, nonconductive contact carrier that is rotatably mounted by a surrounding nonconductive housing for selectively connecting carrier-carried contacts with housing-carried contacts when the carrier is rotated relative to the housing to an "on" position, and that interrupts such connection when the carrier in rotated to an "off" position, with a detent preferably being provided to assist in releasably retaining the carrier in its "off" position. More particularly, the present invention relates to a variable orientation switching receptacle of the type described that is well suited for use as a replacement for conventional electrical receptacles that typically are utilized to receive one or more plural-prong electrical plugs for selectively connecting the conductive prongs of received plugs to a source of electrical energy.

2. Prior Art

The vast majority of electrical receptacles that are installed in the walls of homes, apartments, offices and the like are of the type that include one or more sets of fixed-position female electrical contacts that are configured to receive prongs (male electrical contacts) of appropriately oriented cord-connected plugs. To utilize such receptacles, the power cord of an electrical appliance is extended from the location of the appliance to the location of a wall-mounted receptacle; the cord-connected plug of the appliance is properly oriented such that its prongs are suitably aligned with a set of female contacts of the receptacle; and the properly aligned prongs of the plug are inserted into the receptacle to permit the female contacts to engage, grip and establish electrical contact with the inserted prongs.

One drawback of receptacles of the type just described is that, due to the fixed-orientation character of their female contacts, it often is found that plugs (and electrical cords connected thereto) that are connected to such receptacles interfere with proper placement of furniture and the like. To resolve such conflicts, it is not unknown for plugs to be bent or otherwise detrimentally deformed (and/or for cords connected thereto to be bent sharply or otherwise detrimentally deformed—which can lead to cords becoming frayed, shorted or broken) to conform to limited available space, with the result that fire and electrical hazards may be created.

Another drawback of receptacles having fixed-position contacts is that, if a non-standard plug (e.g., a plug of oversize or cumbersome design, or a right-angle plug or the like) is "plugged into" one of the stations of a two-station receptacle, the configuration of the non-standard plug (and/or the orientation of an electrical cord connected to the non-standard plug) may block the other station of the receptacle, thereby preventing use of the second station. Stated in another way, while it may normally be possible to connect two "standard" plugs to a two-station receptacle, the connection of a "non-standard" plug to one of the receptacle's stations may prevent the other station of the receptacle from concurrently receiving and serving a second plug.

Still another drawback of receptacles having fixed-position contacts is that no provision is made for "deactivating" individual sets of female contacts as a safeguard to ensure that toddlers (who have been known to stick metal objects into the slots of such receptacles) will not be painfully shocked or electrocuted. While it is known to deactivate a receptacle by operating a circuit breaker or an electrical switch, this approach often proves to be inconvenient and/or unacceptable. For example, it often is desired to make use of one set of contacts of a receptacle to operate a lamp or other form of appliance while a remaining set of contacts of the receptacle remains idle. "Idle" contacts that are not deactivated are "alive" (i.e., are connected to a source of electrical energy) and therefore present a hazard to a toddler who decides to probe the "idle" contacts by inserting metal objects into receptacle openings.

While many proposals have been advanced with an eye toward solving one or more of the drawbacks that are discussed above, the need for an electrical receptacle 1) that does not utilize female contacts that are held in a fixed orientation, and 2) that provides an easy-to-use method for individually deactivating sets of female contacts for purposes of safety has been inadequately addressed by prior proposals.

SUMMARY OF THE INVENTION

The present invention addresses the foregoing and other needs and drawbacks of the prior art by providing a novel and improved electrical receptacle that utilizes at least one generally cylindrical, nonconductive contact carrier that is rotatably mounted by a surrounding nonconductive housing for selectively connecting carrier-carried contacts with housing-carried contacts (and thence to a source of electrical energy) when the carrier is rotated to an "on" position that resides within a predetermined angular range of "on" positions, and that interrupts such connection when the carrier is rotated relative to the housing to an "off" position.

A feature of the present invention resides in its providing a very simple, easy-to-use method for "deactivating" a set of female contacts of a receptacle. A particular set of female contacts can be deactivated simply by rotating its carrier relative to the housing to an "off" position. In preferred practice, this "deactivating" movement of a rotatable contact carrier can be effected either by grasping and rotating a plug that is "plugged into" the carrier that is to be rotated, or by grasping and rotating the carrier itself (if no plug currently is "plugged into" the carrier).

Another feature of the present invention is the easy-to-use method it provides for selectively orienting electrical plugs (and their attached electrical cords) that are "plugged into" sets of female contacts of electrical receptacles. Because receptacles that embody the preferred practice of the present invention utilize sets of female electrical contacts that are housed within individually rotatable carriers, and because these carriers are rotatable within relatively wide angular ranges of "on" positions, electrical plugs (and their attached electrical cords) can be individually oriented as is needed to minimize interference in properly positioning furniture and the like at locations adjacent installed receptacles.

In preferred practice, an electrical receptacle embodying the present invention includes a nonconductive housing, a nonconductive carrier that is connected to the housing for relative rotation thereto, a set of housing-carried electrical contacts, and a set of carrier-carried electrical contacts, with these components being arranged and configured in a manner that will permit the housing-carried and carrier-carried contacts to remain electrically connected while the orientations of the contact carriers are suitably adjusted to accommodate special needs of particular receptacle installations.

In accordance with the preferred practice of the present invention, a mechanical "detent" also is incorporated in receptacles of the above-described type for "detenting" each rotatable carrier at its "off" position—so that, once the carrier has been rotated to its "off" position, slightly more than "normal" force (i.e., more force than normally is required to effect carrier rotation) must be applied to rotate the carrier out of its "off" position. By this arrangement, if a toddler has come to comprehend that the carrier of a receptacle is "rotatable," the requirement that "slightly more force than normal" be used to effect carrier rotation out of an "off" position will assist in providing a safeguard.

Because the basic features that are outlined above may be put into practice by providing electrical receptacles that take a variety of forms, the description that follows begins by referring to a schematically depicted receptacle (see FIGS. 1 and 2 that are provided to illustrate relationships among basic receptacle components), whereafter the description turns to features of a particular receptacle embodiment (see FIGS. 3–6 that are provided as being representative of the preferred practice of the present invention). The fact that a box-mountable type of receptacle is shown and described does not mean that features of the present invention are limited to box-mountable types of receptacles.

BRIEF DESCRIPTION OF THE DRAWINGS

The foregoing and other features of the invention will be better understood by referring to the description and claims which follow, taken together with the accompanying drawings, wherein:

DESCRIPTION OF THE PREFERRED EMBODIMENT

Figure 1:
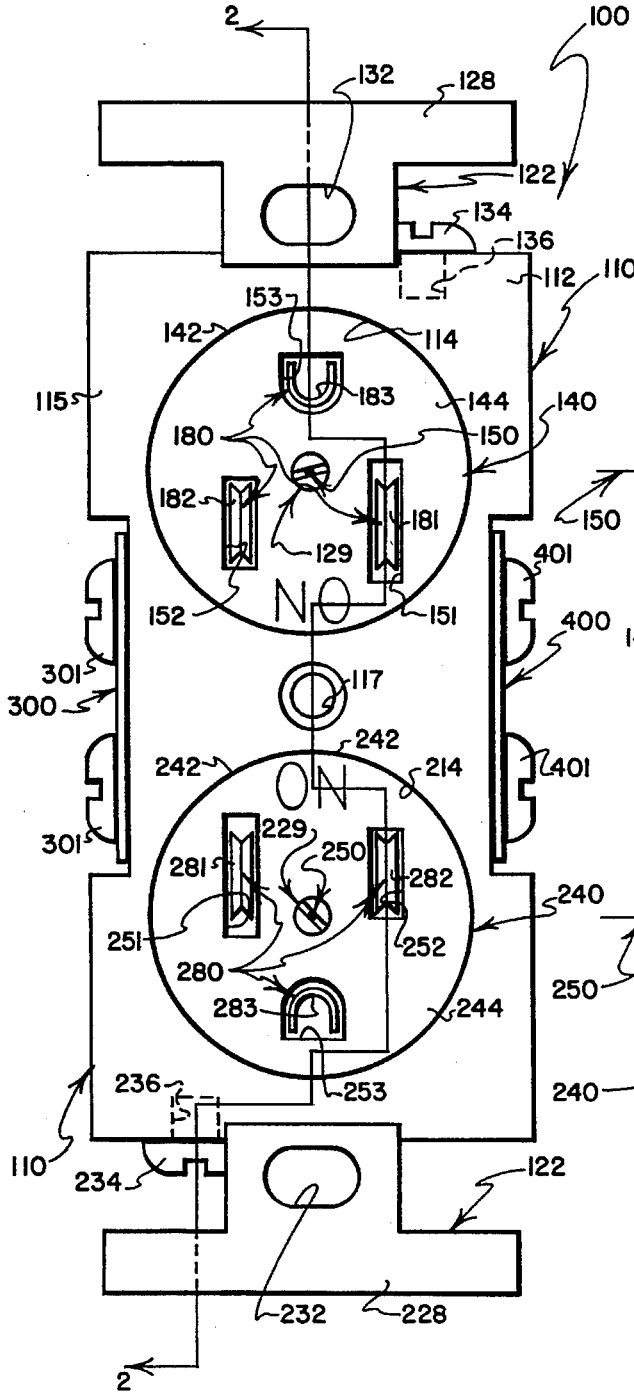
FIG. 1 is a front elevational view of one form of switching type electrical receptacle having two rotatable contact carriers that each carry a separate set of electrical contacts, with the depicted receptacle being of simplified form and being shown somewhat schematically, with the upper of the receptacle's two rotatable contact carriers being angularly oriented relative to a housing of the receptacle in what will be referred to as an "off" position, and with the lower of the contact carriers being angularly oriented relative to the housing in a typical one of many available "on" positions.
Figure 2:
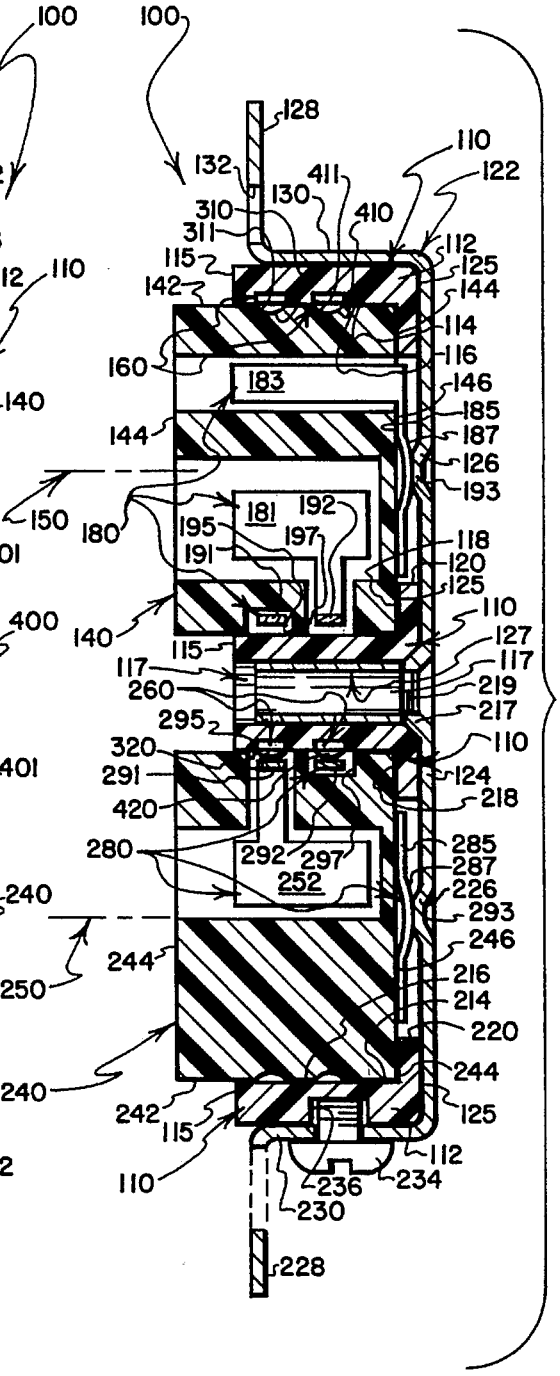
FIG. 2 is a sectional view of the simplified, schematically depicted receptacle of FIG. 1, as seen from planes that are indicated by the broken line 2—2 in FIG. 1.

Referring to FIGS. 1 and 2, a switching type electrical receptacle having a pair of selectively orientable plug-receiving contact carriers is schematically depicted, and is indicated generally by the numeral 100. Major components of the receptacle 100 include a nonconductive housing 110, a pair of identically configured nonconductive carriers 140, 240 that are connected to the housing 110 for relative rotation thereto, two sets of housing-carried electrical contacts (indicated generally by the numerals 160, 260), and two sets of carrier-carried electrical contacts (indicated generally by the numerals 180, 280). Other significant components include a metal mounting bracket 122 that typically is connected to ground land serves to support the housing 110 when the receptacle 100 is mounted in a conventional electrical connection box (not shown), and a pair of wire connection plates 300,400 that extend along opposite sides of the housing 110 for connection with wires (not shown) that deliver electricity to the receptacle 100.

For purposes of simplification, it will be understood that the FIG. 1 and FIG. 2 depictions of the receptacle 100 do not show some components (e.g., fastening devices for retaining rear portions of the rotatable contact carriers 140, 240 within forwardly opening chambers 114, 214 of the housing 110 are not depicted) and do not show some portions of selected components (e.g., portions of housing carried contacts 160, 260 that electrically connect with the wire connection plates 300, 400 are not depicted). Features that are not illustrated in FIGS. 1 and 2 in conjunction with the schematically depicted receptacle embodiment 100 are, nonetheless, suitably described later herein and are depicted, at least in part, in conjunction with the receptacle embodiment 1100.

The housing 110 is principally defined by a generally rectangular, non-electrically-conductive body 112 (typically by injection molded plastic). The housing body 112 defines a pair of generally cylindrical, forwardly facing chambers 114, 214. The chambers 114, 214 have inner diameters that are defined by generally cylindrical interior walls 116, 216, and have rear walls 118, 218, respectively. The cylindrical interior walls 116, 216 of the housing 110 receive and surround rear portions of cylindrical exterior walls 142, 242 of the carriers 140, 240 in a "slip fit" so as to journal the carriers 140, 240 for smooth rotation relative to the housing 110. Rear wall portions 144, 244 of the carriers 140, 240 engage portions of the rear walls 118, 218 of the housing 110.

The housing body 112 has a relatively flat front surface 115, and a relatively flat rear surface 125. The front surface 115 is interrupted at spaced locations where the chambers 114, 214 open through the front surface 115; and at a location spaced mid-way between the chambers 114, 214 where a hole 117 is provided to receive a conventional receptacle cover mounting screw (not shown). The rear surface 125 is similarly interrupted at spaced locations where openings 120, 220 are provided that communicate with the chambers 114, 214; and at a location mid-way between the openings 118, 218 where the hole 117 opens through the rear surface 125. In preferred practice, a metal sleeve 127 is provided to line at least a portion of the length of the hole 117 to reinforce the housing body 112 in the vicinity of the hole 117.

The mounting bracket 122 is an elongate steel stamping that typically is plated with zinc or otherwise protectively coated to minimize corrosion. To securely connect the bracket 122 to the housing 110, it is customary to provide engaging surface portions of the housing 110 and the bracket 122 with interfitting formations (not shown) that either "snap together" and/or that are rigidly connected by other suitable means (e.g., by utilizing conventional fasteners such as rivets), as will readily be understood by those who are skilled in the art.

The mounting bracket 122 has a central portion 124 that overlies much of the rear surface 125 of the housing body 112. Three forwardly extending dimples 126, 226, 217 are formed in the central portion 124 of the mounting bracket 122. The dimples 126, 226 extend substantially centrally into the back wall openings 118, 218, respectively, for the purpose of providing convex contact surfaces 193, 293 that are engaged by carrier-carried dimple-shaped portions 187, 287 of the ground contacts 183, 283. The remaining dimple 217 defines a threaded hole 219 that is aligned with the hole 117 for receiving in threaded engagement the aforementioned conventional cover mounting screw (not shown).

At opposite ends of the elongate mounting bracket 122, T-shaped mounting formations 128, 228 are connected to the central portion 124 by forwardly-rearwardly extending legs 130, 230 of the bracket 122. Mounting holes 132, 232 are formed through the T-shaped mounting formations 128, 228, respectively, for receiving conventional receptacle mounting screws (not shown) that are utilized in a conventional manner for mounting the receptacle 100 in a conventional electrical connection box (not shown).

Ground wire connection screws 134, 234 are threaded into holes that are formed through the legs 130, 230, respectively. Notches 136, 236 are formed in opposite end regions of the housing body 112 to provide clearance for the threaded ends of the screws 134, 234 so that the screws 134, 234 to not exert unwanted force on the housing body 112. When the receptacle 100 is installed in a conventional electrical connection box (not shown) it is customary for a ground wire to be electrically connected to the mounting bracket 122 by utilizing one of the screws 134, 234.

Referring to FIG. 2, the housing-carried contacts 160 include 1) rounded formations 310, 410 that project (at spaced locations) through the cylindrical interior wall 116 and into the chamber 114, and 2) rounded formations 320, 420 that project (at spaced locations) through the cylindrical interior wall 216 and into the chamber 214. The housing-carried contacts 160, 260 also include 1) contact portions (not shown) that electrically connect the wire connection plate 300 (see FIG. 1) to the rounded projections 310, 320 (see FIG. 2), and 2) contact portions (not shown) that electrically connect the wire connection plate 400 (see FIG. 1) to the rounded projections 410, 420 (see FIG. 2). Wire connection screws 301, 401 are carried by the plates 300, 400 for connecting with wires (not shown). Contact portions that are not illustrated in FIGS. 1 and 2 in conjunction with the schematically depicted receptacle embodiment 100 are, nonetheless, suitably described and depicted later herein in conjunction with the receptacle embodiment 1100 (see, in particular, FIGS. 5 and 6 and the description relating thereto).

Referring to FIGS. 1 and 2, the rotatable contact carriers 140, 240 are of identical, generally cylindrical configuration, and are formed from nonconductive material (typically by injection molded plastic). The cylindrical exterior walls 142, 242 of the carriers 140, 240 extend coaxially about central axes 150, 250 of the chambers 114, 214, respectively. The carrier 140 has a front face 144 and a rear face 146. The carrier 240 has a front face 244 and a rear face 246.

Each of the carriers 140, 240 houses three "carrier-carried" plug-engageable contacts that are positioned to be engaged by conventional male contacts that are carried by an appliance-cord-connected electrical plug (not shown). The carrier 140 has passages 151, 152, 153 that open through the front face 144, and that house contacts 181, 182, 183, respectively. The carrier 240 has passages 251, 252, 253 that open through the front face 244, and that house contacts 281, 282, 283, respectively.

Where the passages 151, 152 and 251, 252 open through the cylindrical walls 142, 242, respectively, the contacts 181, 182 and 281, 282 are engageable with the rounded formations 310, 410 and 320, 420 of the housing-carried contacts 160, 260, respectively. However, electrical connections are not formed between the contacts 181, 182 and the rounded formations 310, 410 unless the carrier 140 is in an "on" position—which is not what is illustrated in FIGS. 1 and 2. Electrical connections are, however, formed between the contacts 281, 282 and the rounded formations 320, 420 when the carrier 240 is in its "on" position—which is what is illustrated in FIGS. 1 and 2.

Referring to FIG. 2, ground contacts 183, 283 have rearwardly extending portions 185, 285 that overlie the dimple-shaped contact surfaces 183, 283 that are provided by the dimples 126, 226 of the mounting bracket 122. Regardless of the angular orientation of the carriers 140, 240 relative to the housing body 112, the ground contacts 183, 283 remain electrically connected to the mounting bracket 122—and will thereby be electrically connected to ground when the mounting bracket 122 is so connected.

So that electrical contact will be established between the electrical contacts 181, 182 and the rounded formations 310, 410 (except when the carrier 140 is in its "off" position), the electrical contacts 181, 182 preferably are provided with ring-like portions 191, 192 that reside in perimetrically extending grooves 195, 197 formed in the cylindrical exterior wall 142 of the carrier 140. To define the "off" position of the carrier 140, the ring-like portions 191, 192 are interrupted so that, when the carrier 140 is in its "off" position (as is depicted in FIGS. 1 and 2), the rounded formations 310, 410 extend into engagement with nonconductive material that forms a part of the carrier 140 (rather than extending into engagement with the conductive material that forms the ring-like portions 191, 192).

So that electrical contact will be established between the electrical contacts 281, 282 and the rounded formations 320, 420 (except when the carrier 240 is in its "off" position), the electrical contacts 281, 282 preferably are provided with ring-like portions 291, 292 that reside in perimetrically extending grooves 295, 297 formed in the cylindrical exterior wall of the carrier 240. The "off" and "on" positions of the carrier 240 are defined in the manner just described in conjunction with the carrier 140—with the "on" position of the carrier 240 being depicted in FIG. 2 (wherein the contacts 281, 282 are shown extending into electrically conductive engagement with the rounded formations 320, 420).

To aid in releasably retaining the carriers 140, 240 in their "off" positions, it is desirable to interpose some manner of mechanical "detent" between the housing 110 and each of the carriers 140, 240. One simple form of such a detent is depicted in FIG. 2 wherein the rounded formations 310, 410 are depicted as extending into small dimple-like depressions 311, 411 that are formed in the cylindrical wall 142 of the carrier 140 (at locations that underlie the formations 310, 410 when the carrier 140 is in its "off" position).

With the foregoing description of features of the construction of the receptacle 100, it will be understood that the carrier 140 of the receptacle 100 can be utilized to supply electrical energy to a conventional male plug (not shown) that has its prongs inserted in a conventional manner into the ground contact passage 153 and/or into the power contact passages 151, 152 by rotating the carrier 140 out of its "off"

position (which is depicted in FIGS. 1 and 2) to an "on" position (like that illustrated by the positioning of the carrier 240 in FIGS. 1 and 2). Likewise, the carrier 240 can be utilized to supply electrical energy to a conventional male plug (not shown) that has its prongs inserted in a conventional manner into the ground passage 253 and/or into the power contact passages 251, 252 by rotating the carrier 240 to an "on" position (such as is illustrated in FIGS. 1 and 2). "Off" positioning of the carriers 140, 240 will cause the electrical contacts 181, 182 and 281, 282 to be disconnected from housing-carried contacts 310, 410 and 320, 420, and will thereby terminate the supply of electrical energy from the housing-carried contacts 310, 410 and 320, 420 to the carrier-carried contacts 181, 182 and 281, 282.

Turning now to FIGS. 3–6 wherein the receptacle embodiment 1100 is depicted, it will be noted that the receptacle embodiment 1100 is functionally equivalent to the above-described receptacle embodiment 100. Inasmuch as the receptacle embodiment 1100 has components that correspond to the above-described components of the receptacle embodiment 100, "corresponding numerals" (that differ by a magnitude of one thousand) are utilized in the drawings to designate "corresponding components" of the embodiments 100, 1100. Stated in another way, the description presented above relating to the receptacle embodiment 100 is applicable also to the receptacle embodiment 1100 except that, when applying the description presented above to the embodiment 1100, numerals contained in the above description should each be increased in magnitude by a factor of one thousand. Accordingly, the receptacle 1100 has a housing 1110 that corresponds to the housing 110 of the receptacle; the receptacle 1100 has carriers 1140, 2140 that correspond to the carriers 140, 240 of the receptacle 100; etc.

Figure 3:
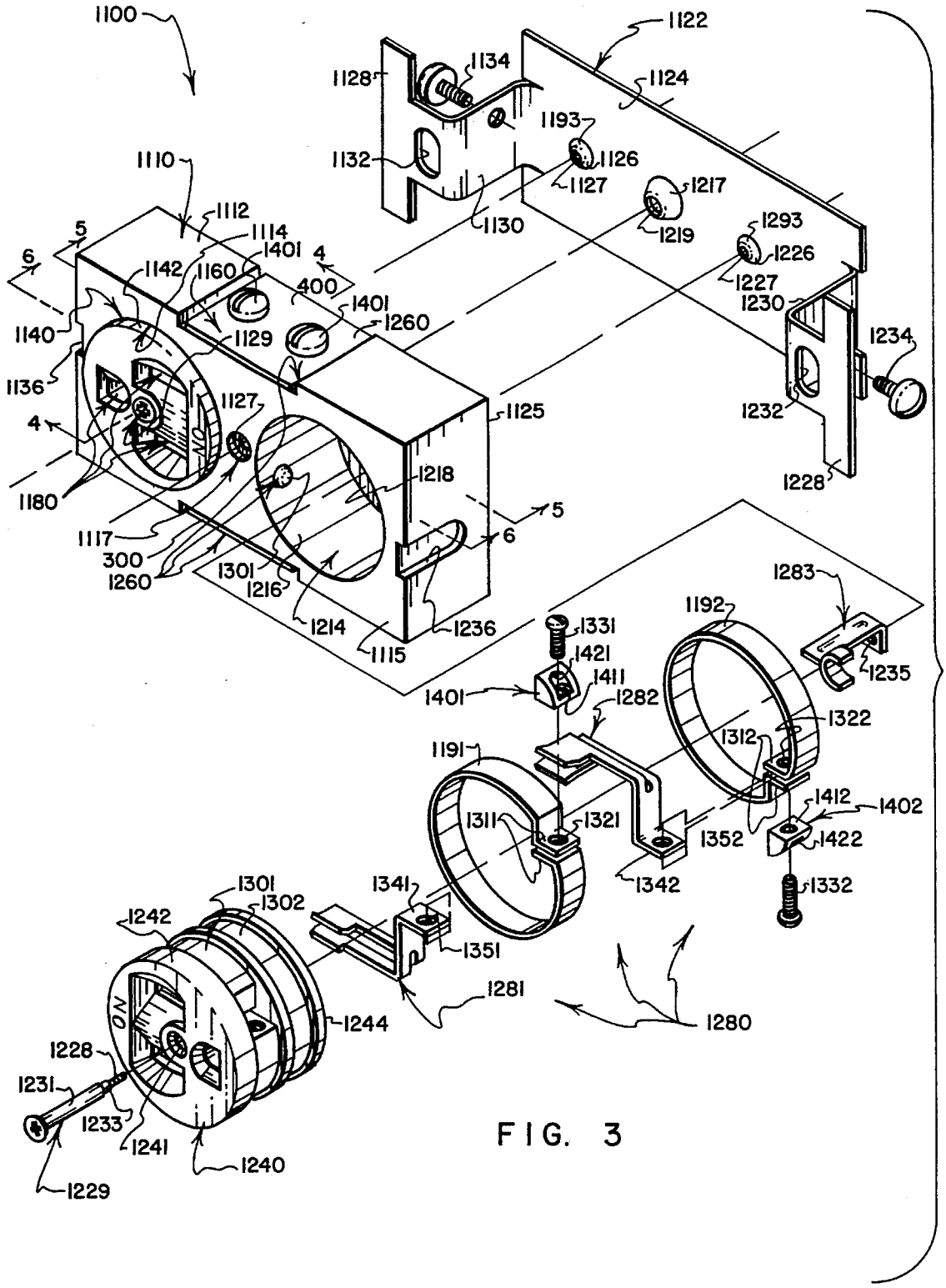
FIG. 3 is an exploded perspective view of selected components and subassemblies of a preferred embodiment of receptacle that incorporates features of the type that are schematically illustrated in FIGS. 1 and 2, with a left one of the receptacle's two rotatable contact carriers being angularly oriented relative to a housing of the receptacle in what will be referred to as an "off" position, and with the right one of the contact carriers being angularly oriented relative to the housing in a typical one of many available "on" positions; and, FIGS. 4, 5 and 6 are sectional views as seen from planes that are indicated by lines 4—4, 5—5 and 6—6, respectively, in FIG. 3, with FIG. 4 having portions of a contact carrier broken away, and with FIGS. 5 and 6 showing only selected housing-related features (and showing no carrier-related features).
Figure 4:
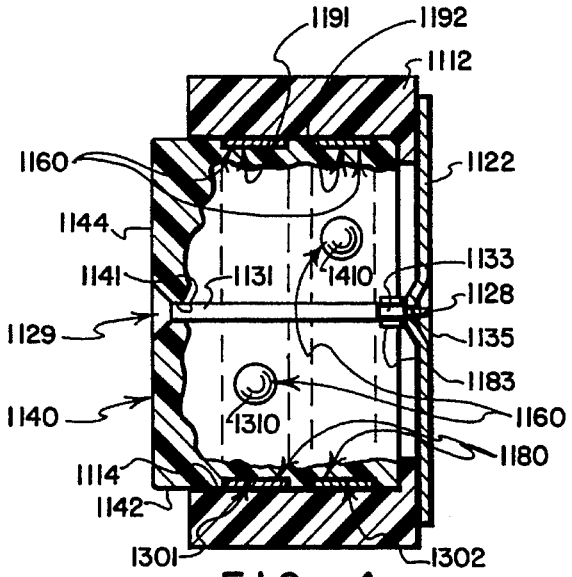

In addition to depicting features of the receptacle embodiments 100, 1100 that "correspond," FIGS. 3–6 also depict other features that remain to be described. For example, the dimple-shaped formations 1126, 1226 (that are defined by the mounting bracket 1122) have internally threaded holes 1127, 1227 for receiving threaded end regions 1128, 1228 of identically configured carrier mounting screws 1129, 1229. The screw 1129 is best seen in FIG. 4. The screw 1229 is best seen in FIG. 3. The screws 1129, 1229 have relatively large diameter portions 1131, 1231 that extend through centrally located mounting holes 1141, 1241 of the carriers 1140, 1240. The screws 1129, 1229 also have relatively smaller diameter portions 1133, 1233 that extend through mounting holes 1135, 1235 that are formed in the ground contacts 1183, 1283, respectively.

The rotatable carrier assemblies 1140, 1240 are of identical configuration and employ sets of component parts that are identical. In FIG. 4, components that form the carrier 1140 are shown "assembled." In FIG. 3, components that form the carrier 1240 are shown "disassembled."

Referring to FIGS. 3 and 4, each of the carriers 1140, 1240 has a pair of ring-shaped conductors 1191, 1192. The conductors 1191, 1192 are formed from bands of electrically conductive metal such as copper. The ring-shaped conductors 1191, 1192 are positioned in spaced grooves 1301, 1302 that extend about portions of the perimeter of the carriers 1140, 1240.

As is best seen in FIG. 3, end regions 1311, 1312 of the conductor bands 1191, 1192 are configured to overlie each other, and are provided with aligned holes 1321, 1322 for receiving rivets 1331, 1332. The contact 1281 has an end region 1341 that is provided with a hole 1351 that is alignable with the holes 1321 to receive the rivet 1331—with the rivet 1331 serving to electrically connect (and to rigidly fasten together) the contact 1281 and the ring-shaped conductor 1191. Likewise, the contact 1282 has an end region 1342 that is provided with a hole 1352 that is alignable with the holes 1322 to receive the rivet 1332—with the rivet 1332 serving to electrically connect (and to rigidly fasten together) the contact 1282 and the ring-shaped conductor 1192.

Referring to FIG. 3, it will be noted that small plastic inserts 1401, 1402 have holes 1411, 1412 formed therethrough to receive the rivets 1331, 1332, whereby the rivets 1331, 1332 also serve to rigidly mount the plastic inserts 1401, 1402 at the junctures of the end regions 1311, 1312 of the ring-shaped conductors 1191, 1192. The plastic inserts 1401, 1402 are nonconducting members that are configured to be engaged by the rounded formations 1310, 1410 and 1320, 1420 of the housing-carried contacts 1160, 1260 when the carriers 1140, 1240 are rotated to their "off" positions. Indentations 1421, 1422 that are formed in the inserts 1401, 1402 (near locations where heads of the rivets 1331, 1332 are received by the inserts 1401, 1402) are engageable by the rounded formations 1310, 1410 and 1320, 1420 of the housing-carried contacts 1160, 1260 when the carriers 1140, 1240 are in their "off" positions, whereby the carriers 1140, 1240 are "detented" at their "off" positions (to assist in releasably retaining the carriers 1140, 1240 in their "off" positions). A more complete showing of the configurations of the housing carried contacts 1160, 1260 is provided in FIGS. 5 and 6.

Figure 5:
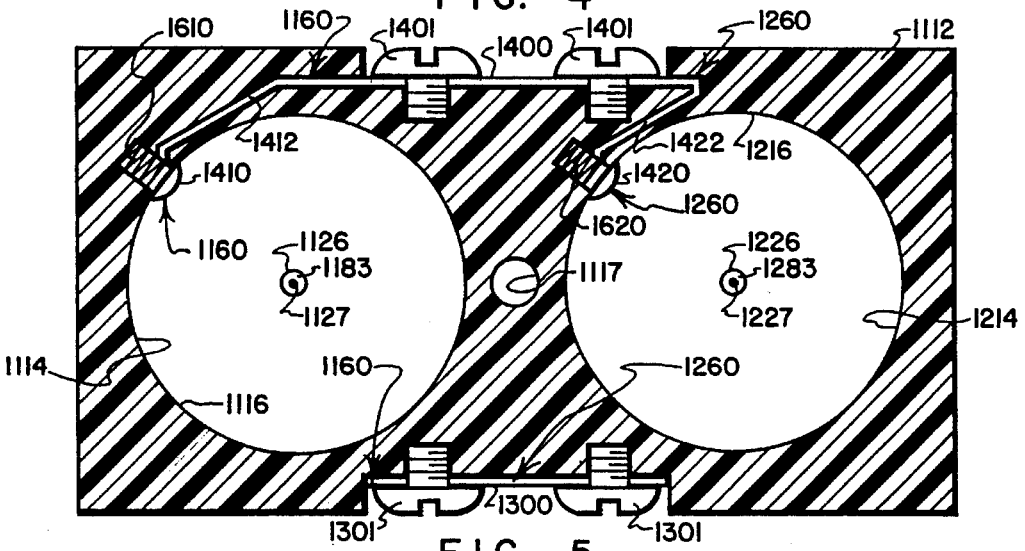
Figure 6:
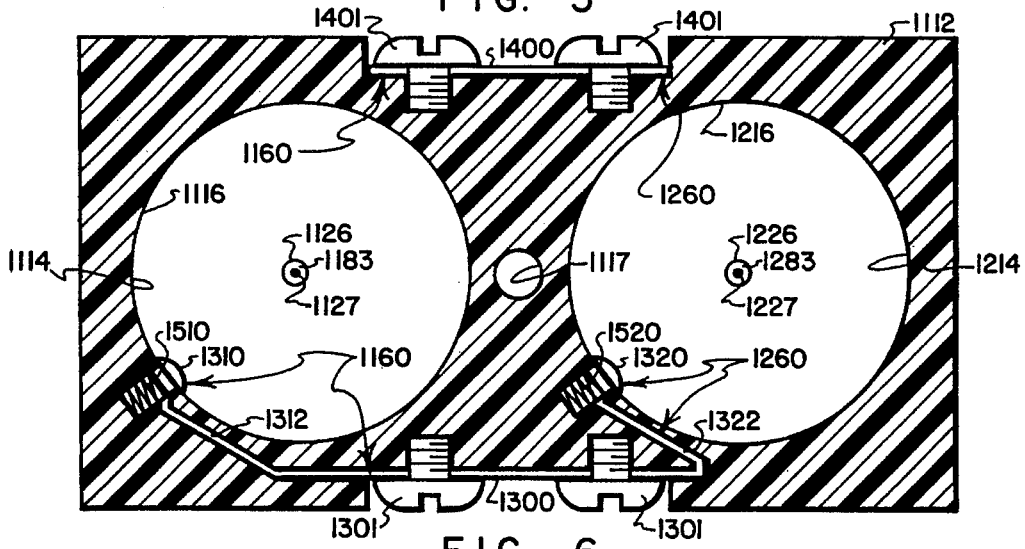

Referring to FIGS. 5 and 6, the character of the "detents" that are provided by rounded formations 1310, 1410 and 1320, 1420 engaging carrier-carried inserts 1401, 1402 when the carriers 1140, 1240 are in their "off" positions can be enhanced by positioning compression coil springs 1510, 1610 and 1520, 1620 to act radially on the rounded formations 1310, 1410 and 1320, 1420 (to bias these formations radially inwardly relative to their associated chambers 1114, 1214, respectively.

Referring to FIG. 6, it will be seen that the rounded formations 1310, 1320 are connected by means of conductors 1312, 1322 to the wire connection plate 1300. Referring to FIG. 5, it will be seen that the rounded formations 1410, 1420 are connected by means of conductors 1412, 1422 to the wire connection plate 1400. The conductors 1312, 1322 and 1412, 1422 extend through suitably configured housing-defined passages that may take the forms that are depicted in FIGS. 5 and 6 (for receiving and housing the conductors 1312, 1322 and 1412, 1422), or that may take other desired forms (not shown) that may, perhaps, be selected in order to render the housing body 1112 simpler and/or less expensive to form, or that may better facilitate implementing a preferred form or desired manner of assembly of the housing-carried conductors 1160, 1260 and the housing body 1112, as will be readily understood by those who are skilled in the art.

By providing the ring-shaped contacts 1191, 1192 (as component parts of the carrier-carried contacts 1180, 1280), and by providing the rounded contact formations 1310, 1320 and 1410, 1420 (as component parts of the housing-carried contacts 1160, 1260), the carrier-carried contacts of the receptacles 100, 1100 will be electrically connected to the wire connecting plates 300, 400 and 1300, 1400 at all times except when the carriers 140, 240 and 1140, 1240 are rotated about their center axes 150, 250, and 1150, 1250 to their discrete "off" positions. By this arrangement the "on" positions of the carriers 140, 240, 1140, 1240 will comprise the vast majority of the possible angular orientations of the carriers 140, 240 and 1140, 1240 relative to their housings 110, 1110, and will permit male electrical plugs (and power cords connected thereto) to be oriented in almost any desired direction as the cords extend away from the receptacles 100, 1100.

A feature of the invention that is best depicted in FIG. 1 calls for the use of the letters "O" and "N" to assist in identifying the orientations of the carriers 140, 240. When in a mid-range "on" position, the carrier 240 is depicted as displaying the letters "O" and "N" in a format that spells the word "ON"—whereas, when in an "off" position, the carrier 140 is depicted as displaying the letters "O" and "N" spell the word "NO." While the use of the letters "O" and "N" to form the words "ON" and "NO" is by no means "essential," in preferred practice this feature can be of aid in identifying relative positions of the carriers 140, 240.

While the drawings and the description provided herewith depict a "box mountable" form of receptacle, it will be understood that features of the present invention are not limited to use with box-mountable receptacle embodiments but rather can be utilized with a wide variety of female electrical receptacles—substantially anywhere that female electrical connectors are provided, for example at the ends of extension cords and the like.

As will be understood by those who are skilled in the art, other features—features that may have merit when a receptacle is to be deployed in a special set of circumstances—can be incorporated in receptacles of the type described without departing from the spirit and scope of the present invention. For example, one or more torsion coil springs (or other suitable means for applying torsion force, not shown) may be interposed between the carriers 140, 240 and the housing 120 (or between the carriers 1140, 1240 and the housing 1120) to return the carriers to their "off" positions when the carriers are not in use. A drawback that tends to be associated with the use of such an optional feature, however, is that "stops" (not shown) may need to be provided to limit the range of relative angular movement that is permitted to take place between each carrier and its associated housing (e.g., to a range of three hundred sixty degrees or less) to ensure that torsion coil springs (or other forms of carrier rotation devices) do not become "overwound," "over-extended" or otherwise detrimentally affected.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty as exist in the invention.

What is claimed is:

1. An electrical receptacle, comprising:

a) housing means including a nonconductive body formed from electrically insulating material, with the body having exterior wall means for defining a front face and a rear face, and with the body having interior wall means located between the front and rear faces for defining a forwardly opening chamber, with the interior wall means including a generally cylindrical interior wall 1) that extends perimetrically about at least a portion of the chamber, 2) that opens through the front face of the body, and 3) that extends rearwardly from the front face while also extending substantially concentrically about an imaginary forwardly-rearwardly extending center axis that extends substantially centrally through the chamber;

b) carrier means including a generally cylindrical, nonconductive carrier formed from electrically insulating material having a front portion that defines a generally circular front face, and a rear portion formed by rear surfaces that include a generally cylindrical exterior wall that is sized and configured to permit the rear portion of the carrier to be moved along the center axis relative to the body so as to effect insertion of the rear portion of the carrier into the chamber of the body to an "assembled" configuration wherein the exterior surface of the carrier extends concentrically about the center axis while being surrounded in relatively closely spaced relationship by the interior surface of the body so that, with the interior surface of the body and the exterior surface of the carrier being sized and configured such that, when the the carrier and the body are in said "assembled" configuration, the carrier can be rotated about the center axis relative to the body between a first relative orientation that defines an "off" position and a second relative orientation that defines an "on" position;

c) mounting means connected to the body and to the carrier for retaining the carrier and the body in said assembled position while, at the same time, permitting the carrier to rotate about the center axis relative to the body between said "off" and "on" positions;

d) carrier passage means defined by the carrier including a plurality of carrier passages that each have 1) an associated forward end region, 2) an associated rearward end region, and 3) an associated connecting region that extends between and communicates the associated forward and rearward end regions, with the forward end regions opening through the front face of the carrier at spaced locations, and with the rearward end regions opening through the rear surfaces of the carrier at spaced locations;

e) housing passage means defined by the body including a plurality of body passages that each have 1) an associated interior end region, 2) an associated exterior end region, and 3) an associated communicating region that extends between and communicates the associated interior and exterior end regions, with the interior end regions opening through the interior wall means at spaced locations, and with the exterior end regions opening through the exterior wall means at spaced locations;

f) carrier contact means including a plurality of electrically conductive members each of which extends through a separate one of the carrier passages for defining 1) an associated female contact, 2) an associated sliding contact, and 3) an associated interconnecting portion, with the associated female contact being situated near the forward end region of the associated carrier passage, with the associated sliding contact being situated near the rearward end region of the associated carrier passage, and with the associated interconnecting portion extending uninterrupted through the associated carrier passage to electrically interconnect the associated female electrical contact and the associated sliding contact;

g) housing contact means including a plurality of electrically conductive elements each of which extends through a separate one of the body passages for defining 1) an associated interior contact, 2) an associated exterior contact, and 3) an associated intercoupling portion, with the associated interior contact being situated near the interior end region of the associated carrier passage, with the associated exterior contact being situated near the associated exterior end region, with the associated intercoupling portion extending uninterrupted through the associated body passage to electrically interconnect the associated interior contact and the associated exterior contact;

h) with the sliding contacts and the interior contacts being configured such that, when the carrier and the body are in said "assembled" configuration and are rotated relative to each other about the center axis to said "on" position, each of the sliding contacts engages and establishes electrical connection with a separate one of the interior contacts; and, i) with the sliding contacts and the interior contacts being configured such that, when the carrier and the body are in said "assembled" configuration and are rotated relative to each other about the center axis to said "off" position, at least one of the sliding contacts disengages and provides no electrical connection with any of the interior contacts.

2. The electrical receptacle of claim 1 wherein each of the exterior contacts includes formation means for receiving and facilitating connection with a separate electrical wire for coupling the exterior contacts to a source of electrical energy so that electrical energy from the source will be delivered to the housing contact means and thence to the carrier contact means when the carrier and the body are rotated relative to each other to assume said "on" position.

3. The electrical receptacle of claim 1 wherein:

a) at least one of the sliding contacts includes an elongate electrically conductive member that is physically connected to the carrier and that extends along at least a portion of the generally cylindrical exterior wall; and, b) at least one of the interior contacts includes an electrically conductive element that engages and makes electrical contact with the elongate electrically conductive member when the carrier and the body are in said "on" position, but which neither engages nor makes electrical contact with the elongate electrically conductive member when the carrier and the body are in said "off" position.

4. The electrical receptacle of claim 1 wherein:

a) at least two of the sliding contacts each includes an elongate electrically conductive member that is physically connected to the carrier and that extends along at least a portion of the generally cylindrical exterior wall; and, b) at least two of the interior contacts each includes an electrically conductive element that engages and makes electrical contact with a separate one of the elongate electrically conductive members when the carrier and the body are in said "on" position, but which neither engage nor make electrical contact with the elongate electrically conductive members when the carrier and the body are in said "off" position.

5. The electrical receptacle of claim 1 additionally including detent means connected to at least a selected one of the carrier and the body for detenting the carrier and the body when the first and second housing means are in said "off" position for releasably retaining the carrier and the body in said "off" position.

6. The electrical receptacle of claim 1 wherein indicia means is provided on the circular front face of the carrier for providing an indication of whether the carrier is said "off" position or in said "on" position.

7. The electrical receptacle of claim 6 wherein said indicia means includes the letters "O" and "N" that are provided on the circular front face so as to spell the word "NO" when the carrier is in said "off" position, and to spell the word "ON" when the carrier is in said "on" position.

8. A female electrical receptacle, comprising:

a) first housing means formed from electrically insulative material for defining a front face and an outer wall that extends in a generally cylindrical manner about an imaginary center axis that extends rearwardly from the front face, and for defining a plurality of openings that open through the front face, with said openings being arranged in an array and being configured such that each of the openings will receive a separate one of a plurality of male electrical contacts of a suitably configured electrical plug when the male contacts of the plug are inserted concurrently into said openings;

b) second housing means formed from electrically insulative material for being movably connected to the first housing means when the first and second housing means are "assembled," with the second housing means defining a front surface and a generally cylindrical inner wall that is configured to receive and closely surround at least a portion of the cylindrical outer wall of the first housing means when the first and second housing means are assembled, whereby, when the first and second housing means are assembled, the second housing means journals the first housing means for relative rotation about said center axis between discrete relative position of the first and second housing means referred to as an "off" position, and a range of relative positions of the first and second housing means referred to as a range of "on" positions;

c) a plurality of first electrical contacts that are carried by the first housing means, and that each extend adjacent to a separate one of said openings for engaging and establishing electrical connection with a separate one of the male electrical contacts when the male contacts of the plug are inserted concurrently into said openings;

d) a plurality of second electrical contacts that are carried by the second housing means, with each of the second electrical contacts being configured to be connected to a separate electrical wire so that electrical energy can be delivered by connected wires from a source of electrical energy to the second electrical contacts; and, e) sliding contact means interposed between the first and second electrical contacts for selectively establishing electrical connection therebetween with each of the first electrical contacts being electrically connected to a separate associated one of the second electrical contacts when the first and second housing means are in said "on" positions, and for breaking electrical connection between at least one of the first electrical contacts and its associated one of the second electrical contacts when the first and second housing means are in said "off" position.

9. The electrical receptacle of claim 8 wherein the sliding contact means includes:

a) at least one elongate electrically conductive member that is physically connected to a selected one of the first and second housing means, and that extends along at least a portion of the periphery of the outer cylindrical wall of the first housing means; and, b) at least one electrically conductive element that is physically connected to the other of the first and second housing means, and that engages and makes electrical contact with the elongate electrically conductive member when the first and second housing means are in said "on" position, but which neither engages nor makes electrical contact with the elongate electrically conductive member when the first and second housing means are in said "off" position.

10. The electrical receptacle of claim 9 wherein said elongate electrically conductive member is physically connected to the first housing means, wherein said electrically conductive element is physically connected to the second housing means, and wherein electrically conductive contact is maintained between said elongate electrically conductive member and said electrically conductive element when the first and second housing means are positioned relative to each other within said range of "on" positions, but wherein electrically conductive contact is broken between said elongate electrically conductive member and said electrically conductive element when the first and second housing means are positioned relative to each other in said "off" position.

11. The electrical receptacle of claim 8 additionally including detent means connected to at least a selected one of the first and second housing means for detenting the first and second housing means when the first and second housing means are in their "off" position for releasably retaining the first and second housing means in their "off" position.

12. The electrical receptacle of claim 8 wherein the sliding contact means includes:

a) at least two elongate electrically conductive members that are physically connected to a selected one of the first and second housing means, and that extend along at least a portion of the periphery of the outer cylindrical wall of the first housing means; and, b) at least two electrically conductive elements that are physically connected to the other of the first and second housing means, and that engage and make electrical contact with the elongate electrically conductive members when the first and second housing means are in said "on" position, but which neither engage nor make electrical contact with the elongate electrically conductive members when the first and second housing means are in said "off" position.

13. The electrical receptacle of claim 8 wherein indicia means is provided on the front face of the first housing means for providing an indication of whether the first and second housing means are in said "off" position or in said "on" position.

14. The electrical receptacle of claim 13 wherein said indicia means includes the letters "O" and "N" that are provided on the front face so as to spell the word "NO" when the first and second housing means are in said "off" position, and to spell the word "ON" when the first and second housing means are in said "on" position.

15. An electrical receptacle, comprising:

a) non-electrically-conductive housing means for defining a housing member having a forwardly-facing cavity that is defined, at least in part, by a generally cylindrical inner wall that extends substantially concentrically about an imaginary, forwardly-rearwardly extending center axis;

b) non-electrically-conductive carrier means for defining a carrier member having a forwardly-facing front wall, having a rearwardly-extending portion that define a generally cylindrical outer wall that is configured to be receivable within the forward-facing cavity, with the carrier member being rotatable relative to the housing member about the center axis while the outer wall is closely surrounded by the inner wall, with relative angular movement between the housing and carrier members being permitted from an "off" position through range of "on" positions;

c) plug prong receiving means including a plurality of forwardly-facing openings defined by the carrier and opening through the front wall of the carrier for concurrently receiving plural prongs of a suitably configured electrical plug, with said openings extending rearwardly from the front wall in directions substantially paralleling the center axis;

d) electrical connector means carried by the housing for being connected to a source of electrical energy; and, e) electrical contact means carried by the housing and by the carrier, including slidingly engageable contacts extending along the juncture of said inner and outer walls and communicating with said forwardly-facing openings for electrically connecting plug prongs that are received within said openings when said carrier is positioned relative to said housing within said "on" range of angular positions, and for interrupting electrical connection of said prongs and said source when said carrier is positioned relative to said housing in said "off" position.

16. The electrical receptacle of claim 15 wherein the slidingly engageable contacts include:

a) at least one elongate electrically conductive member that is physically connected to a selected one of the housing and carrier means, and that extends along at least a portion of the periphery of the cylindrical outer wall of the carrier means; and, b) at least one electrically conductive element that is physically connected to the other of the housing and carrier means, and that engages and makes electrical contact with the elongate electrically conductive member when the housing and carrier means are in said "on" position, but which neither engages nor makes electrical contact with the elongate electrically conductive member when the housing and carrier means are in said "off" position.

17. The electrical receptacle of claim 16 wherein said elongate electrically conductive member is physically connected to the carrier means, wherein said electrically conductive element is physically connected to the housing means, and wherein electrically conductive contact is maintained between said elongate electrically conductive member and said electrically conductive element when the housing and carrier means are positioned relative to each other within said range of "on" positions, but wherein electrically conductive contact is broken between said elongate electrically conductive member and said electrically conductive element when the housing and carrier means are positioned relative to each other in said "off" position.

18. The electrical receptacle of claim 15 additionally including detent means connected to at least a selected one of the housing and carrier means for detenting the housing and carrier means when the housing and carrier means are in their "off" position for releasably retaining the housing and carrier means in their "off" position.

19. The electrical receptacle of claim 15 wherein indicia means is provided on the front wall of the carrier means for providing an indication of whether the housing and carrier means are in said "off" position or in said "on" position.

20. The electrical receptacle of claim 19 wherein said indicia means includes the letters "O" and "N" that are provided on the front wall so as to spell the word "NO" when the housing and carrier means are in said "off" position, and to spell the word "ON" when the housing and carrier means are in said "on" position.

* * * * *